United States Patent [19]

Hirschmanner

[11] Patent Number: 4,572,453

[45] Date of Patent: Feb. 25, 1986

[54] COILER FOR STRIP METAL

[75] Inventor: Franz Hirschmanner, Leoding, Austria

[73] Assignee: Voest-Alpine Aktiengesellschaft, Linz, Austria

[21] Appl. No.: 647,671

[22] Filed: Sep. 5, 1984

[30] Foreign Application Priority Data

Oct. 21, 1983 [AT] Austria ..... 3741/83

[51] Int. Cl.[4] ..... B65H 17/02

[52] U.S. Cl. ..... 242/72 R

[58] Field of Search ..... 242/72 R, 682, 721; 269/48.1; 279/2 R

[56] References Cited

U.S. PATENT DOCUMENTS

| | | | |
|---|---|---|---|
| 668,107 | 2/1901 | Loscher | 242/72 |
| 720,169 | 2/1903 | Mills | 242/72 |
| 749,114 | 1/1904 | Surmann et al. | 242/72 |
| 1,337,017 | 4/1920 | Kenworthy . | |
| 2,454,984 | 11/1948 | Bader | 242/72 |
| 2,586,527 | 2/1952 | Ferm . | |
| 2,919,894 | 1/1960 | Hepler . | |
| 3,456,893 | 7/1969 | Michelson | 242/72.1 |
| 3,923,269 | 12/1975 | Urynowicz | 242/72 X |
| 4,254,920 | 3/1981 | Peterson . | |
| 4,284,251 | 8/1981 | Castillo | 242/68.4 |

FOREIGN PATENT DOCUMENTS

| | | |
|---|---|---|
| 1947327 | 4/1970 | Fed. Rep. of Germany . |
| 1121836 | 5/1956 | France . |

*Primary Examiner*—Stuart S. Levy
*Assistant Examiner*—Lloyd D. Doigan
*Attorney, Agent, or Firm*—Kurt Kelman

[57] ABSTRACT

A coiler comprises a rotatably mounted coiler shaft, adapted to be driven, and a hollow reel, non-rotatably connected to the coiler shaft and containing a mechanism for expanding the coil. The expanding mechanism is adapted to be actuated by an actuator and comprises radially adjustable pressure-applying members, adapted to protrude through apertures in the reel at its periphery. To ensure that the coiler will be operable even under high loads, the pressure-applying members are spaced along the reel and mounted on two diamatically expanding opposite members, operatively connected to the actuating mechanism. The expanding members are pivoted on diametrically opposite axes which extend parallel to the axis of the coiler shaft.

11 Claims, 3 Drawing Figures

COILER FOR STRIP METAL

BACKGROUND OF THE INVENTION

1. Technical Field

This invention relates to a coiler for strip metal comprising a rotatably mounted drivable coiler shaft and a hollow reel, non-rotatably connected to the coiler shaft and contains an expanding mechanism, which is operable by an actuator and comprising radially adjustable pressure-applying members, protruding through apertures in the reel to engage the coil.

2. Description of the Prior Art

Coilers having an expanding mandrel have the advantage that a non-positive coupling which is sufficient for the coiling of a strip can be established between the expanding segments of the expanding mandrel and the coil so that the disadvantages involved in the introduction of the leading end of the strip into a receiving slot are avoided. These disadvantages reside in that the coiler shaft must be arrested, the strip may be pinched as the reel is raised, and the leading end of the strip is reversely bent.

On the other hand, coilers comprising an expanding mandrel involve a relatively complex structure and their load-carrying capacity is restricted. For this reason, coilers having no expanding mandrel are used for hot strip because the heat from the hot strip which may be at temperatures between 180° and 1200° C., reduces the load-carrying capacity of such expanding mandrels. This applies not only to expanding mandrels having expanding segments but also for expanding mandrels which comprise a hollow reel, connected to the coiler shaft and radially adjustable pressure-applying members, movable through the reel into engagement with the coil (U.S. Pat. No. 4,254,920). In these coilers, the pressure-applying members for establishing a non-positive coupling to the coil are held in slide tracks and are separated by actuating wedges, which are axially slidably mounted in the hollow coiler shaft. During the coiling of hot strip, all these structural parts are subjected not only to a mechanical load but also to a high heat load. For this reason these known coilers cannot be used to coil hot strip.

SUMMARY OF THE INVENTION

It is an object of the invention to avoid the above-mentioned disadvantages and to provide a coiler which is adapted to coil hot strip and comprises a simple expanding mechanism and can safely absorb the mechanical and thermal loads.

In a coiler of the kind described first hereinbefore, this object is accomplished in accordance with the invention with pressure-applying members which are spaced apart along the reel and mounted on at least one expanding member, connected to the actuator and pivoted on an axis which is parallel to the axis of the coiler shaft.

Because the pressure-applying members are mounted on at least one expanding member, the pressure-applying members can be jointly moved in groups so that there is no need for separate connections between the actuator and respective pressure-applying members. As a result, the actuator, which is subjected to a particularly high mechanical load, can be disposed outside the reel and axially spaced therefrom so that the actuator will not be subjected to a high heat load. Because the or each expanding member is pivoted on an axis which is parallel to the axis of the coiler shaft, the load can be absorbed in a simple manner without restricting the movement of the expanding members. In such a mounting arrangement the pressure-applying members cannot be canted in a slide track because they can be radially adjusted without a guidance in the reel. Even under a high heat load the reel can absorb strong forces in the peripheral direction and strong bending forces because the apertures through which the pressure-applying members protrude do not involve a substantial weakening of the shell of the reel, which is closed except for these apertures.

Whereas a single expanding member may be sufficient, it will be desirable to provide two expanding members in the hollow reel, which expanding members are capable of equal and opposite movements about diametrically opposite axes so that rotary unbalance and the need for a compensation thereof will be avoided.

Because the expanding members are pivotally movable, the mountings for the expanding members can be disposed outside the reel so that these mountings will not be subjected to a substantial heat load.

Various kinds of drive means may be used to impart a pivotal movement to the expanding members. In order to ensure that the loads encountered will be absorbed by simple means, it is recommendable to connect the expanding members to actuating levers, which are spaced from the pivotal axes of the expanding members and are connected to an actuating rod, mounted to be displaceable in the longitudinal direction of the reel. In response to the operation of the actuating rod, the actuating levers are pivotally moved to impart to the expanding members a pivotal movement about their pivotal axes so that the pressure-applying members protrude through the apertures in the reel and are forced against the coil. The coil will be released by an actuating movement in the opposite direction.

Because the pivotal movement of the expanding members involves an additional angular movement of the actuating levers, the latter must be free to perform that additional angular movement. For this purpose, the actuating rod may be mounted for rotation about its axis relative to the reel. In that case, the bearings between the actuating levers and the actuating rod will not be subjected to constraining forces.

But the freedom of the actuating rod to rotate about its axis does not preclude the occurrence of constraining forces in the pivotal connections between the actuating levers and the expanding members. Such constraining forces can be eliminated by connecting the adjusting levers and expanding members by ball joints, which permit a transverse angular movement of the adjusting levers.

If the pivotal connections between the actuating levers and the actuating rod are disposed ouside and axially spaced from the reel, pivotal movements can be imparted to the expanding members by a parallel crank linkage so that the forces can act in a desirable manner and the expanding mechanism is substantially relieved from heat loads because most of the moving parts and articulated joints of the expanding mechanism are disposed outside the reel.

DESCRIPTION OF THE PREFERRED EMBODIMENT

Figure 1:
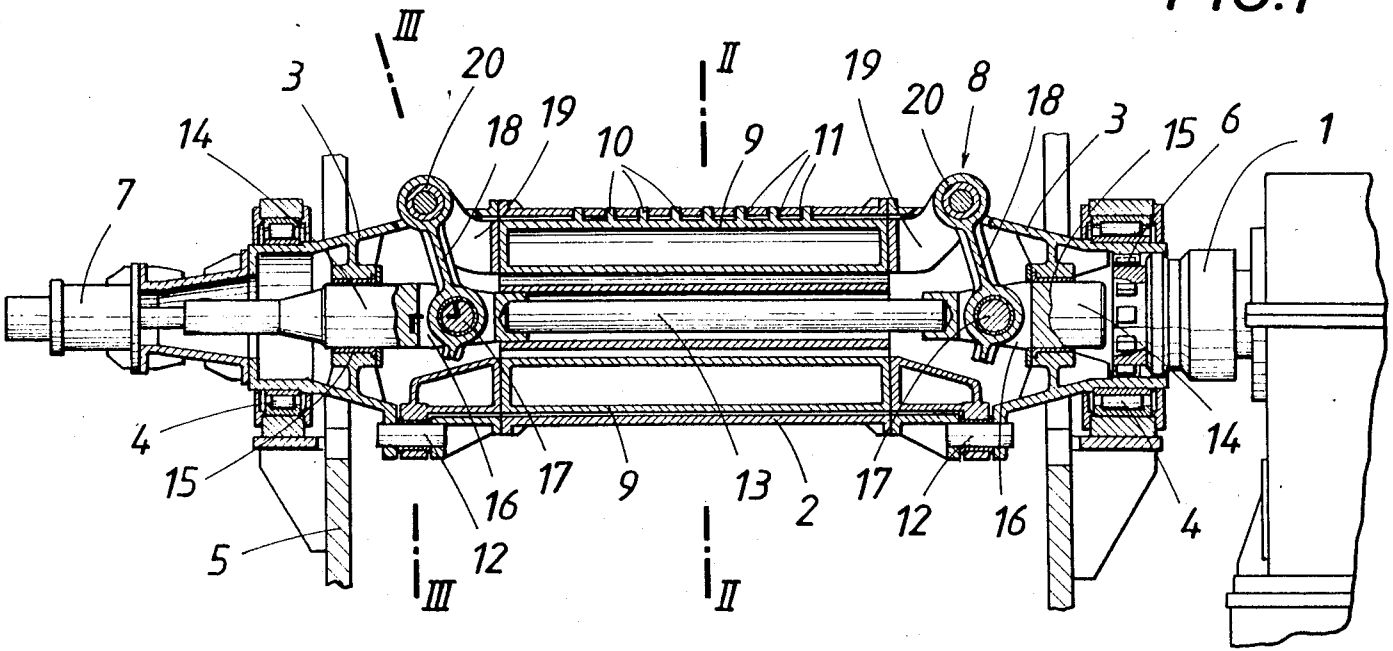
FIG. 1 is a simplified longitudinal sectional view taken on line I—I in FIG. 3 and showing a coiler embodying the invention.

As is particularly apparent from FIG. 1, the coiler comprises a rotatable coiler shaft 1 for driving a hollow reel 2. The latter is connected at each end to a hollow trunnion 3, by which the reel 2 is rotatably mounted in bearings 4 carried by a frame 5.

For the purposes of the present invention, the reel is the structure which is intended to be surrounded by the coil of strip metal being wound and does not include those elements, such as the hollow trunnion 3, which are non-rotatably connected to the reel but protrude axially from such coil and are rotatably mounted in the frame of the coiler.

The coiler shaft 1 is non-rotatably connected to the reel 2 by splines provided in the trunnion 3 at the driven end of the reel. An actuator adjacent to the opposite trunnion 3 comprises, e.g., a fluid-operated cylinder 7 and serves to actuate an expanding mechanism 8 which comprises two radially adjustable expanding members 9 extending through hollow reel 2. These expanding members 9 are disposed diametrically opposite to each other with respect to the axis of the reel and each for pressure-applying members 10, spaced apart along the reel and protrude in a radial direction. In response to an actuation of the expanding members 9 in a radially outward direction, pressure-applying members 10 extend through associated apertures 11 in the periphery of the reel and apply pressure to the coil, which is thus coupled firmly to the reel 2 between the two expanding members. In this manner, a non-positive connection which is sufficient for a transmission of torque is established between the reel and the coil.

To avoid the use of tracks in sliding contact with the expanding members 9 during their radial adjustment, the expanding members 9 are pivoted on respective pivots 12 having axes which are parallel to the axis of the coiler shaft 1. The pivots 12 are sufficiently spaced from the pressure-applying members 10 so that a sufficiently large movement can be imparted to the pressure-applying members 10 by a pivotal movement of the expanding members.

The pivots 12 for the expanding members 9 are accommodated in the hollow trunnions 3 so that they are disposed outside and axially spaced from the reel 2. For this reason, the mountings for the expanding members 9 are not subjected to a direct heat load by the hot strip being coiled. Besides, a major part of the forces which are exerted will be absorbed by the reel 2 so that only part of the load is applied to the expanding mechanism 8 and in spite of the high heat load the coiler is capable of absorbing large forces.

Figure 2:
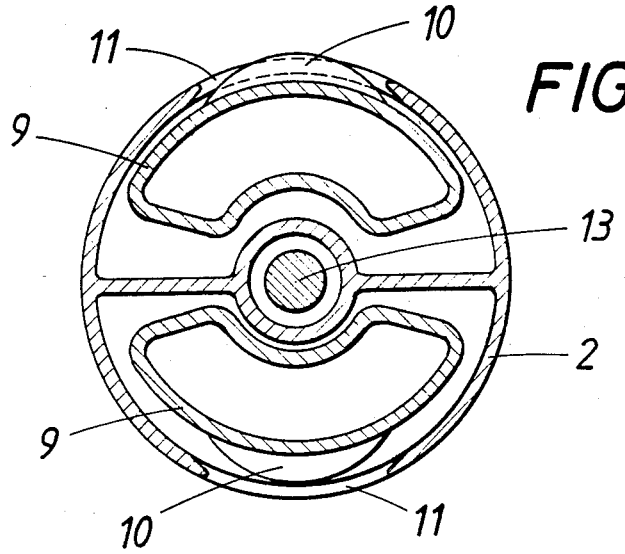
FIG. 2 is a highly diagrammatic enlarged transverse sectional view taken on line II—II in FIG. 1.
Figure 3:
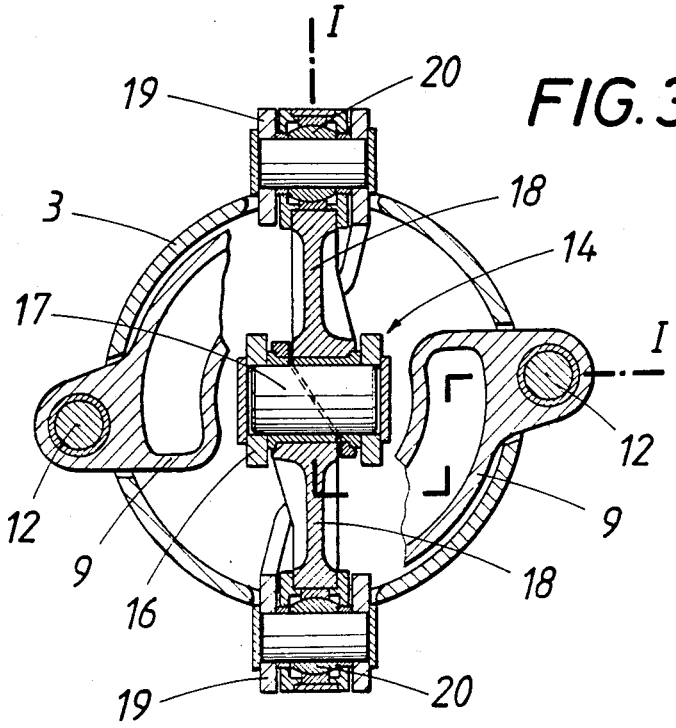
FIG. 3 is an enlarged transverse sectional view taken on line III—III in FIG. 1 and showing a trunnion connected to the reel.

In the present embodiment, the expanding members 9 are operated by an actuating rod 13, which coaxially extends through the reel 2 and is connected to the actuator 7 and provided at both ends with mounting heads 14. In sliding surface bearings 15 disposed in the hollow trunnions 3, the mounting heads 14 are mounted for rotation and for a slidable movement in the longitudinal direction of the reel. Each mounting head 14 of the actuating rod 13 comprises two yokes 16, carrying respective pivots 17 connected to actuating levers 18, pivoted to respective mounting yokes 19 provided at the ends of the expanding members 9. During a pivotal movement imparted to the expanding members 9 by the actuating levers 18, the latter are constrained to perform also an angular movement at right angles to their actuating movement so that the actuating levers must be free to perform such movement. For this purpose, the actuating rod 13 is rotatably mounted in the sliding surface bearings 15 and spherical joints 20 are provided between the actuating levers 18 and the expanding members 9 which permit the actuating levers 18 to perform the required transverse movement relative to the expanding members 9. Owing to that arrangement, a displacement of the actuating rod 13 will cause the actuating levers 18, which constitute parallel crank linkages, to force the expanding members 9 radially outwardly and inwardly without an occurrence of constraining forces. This is indicated in FIG. 2, in which the lower expanding member 9 is shown in a position in which the associated pressure-applying member is retracted from the associated aperture 11 of the reel 2. In that retracted position, the pressure-applying member 10 has a slight eccentricity with respect to the aperture 11. That eccentricity is not shown in FIG. 2 for the sake of simplicity.

Because a major part of the means for actuating the expanding mechanism 8 is disposed adjacent to the hollow trunnions 3, outside the reel 2 which is directly subjected to the heat from the hot strip, the thermal load on the expanding mechanism 8 will be relatively small. A major part of the load is taken up by the reel 2, which is closed except for the apertures 11 receiving the pressure-applying members 10. For this reason, the coiler in accordance with the invention will be capable to absorb all loads which are to be expected, even under a high heat load. The susceptibility to heat can be further reduced by heat barriers between the reel 2 and the hollow trunnions 3 and between the expanding members 9 and the mounting yokes 19. Such heat barriers might be constituted, e.g., by cooling passages through which a coolant flows and which are provided adjacent to the flanges by which the reel 2 is connected to the hollow trunnions 3 and between the expanding members 9 and their mounting yokes 19.

I claim:

1. A coiler for forming a coil of strip metal, comprising (a) a rotatably mounted coiler shaft adapted to be driven about an axis;

(b) a coaxial hollow reel having a periphery for supporting the coil and non-rotatably connected to the coiler shaft, (1) the hollow reel defining a plurality of apertures in the periphery thereof;

(c) a plurality of members associated with respective ones of the apertures and radially movable between a first position wherein the members are retracted from the apertures and a second position wherein the members protrude from the apertures to apply pressure to the coil supported on the periphery of the hollow reel;

(d) an expanding mechanism extending through the reel for moving the pressure-applying members into the second position;

(e) an actuating mechanism operatively connected to the expanding mechanism and operable to move the pressure-applying members into the second position; and the improvement of (f) said apertures and said pressure-applying members being axially spaced apart along said reel;

(g) said expanding mechanism comprising two expanding members disposed diametrically opposite each other with respect to the axis and carrying said pressure-applying members, (1) the expanding members being pivotally movable relative to the hollow reel about diametrically opposite pivotal axes which extend parallel to the axis and (2) the actuating mechanism being operable to impart equal and opposite movements to the expanding members about the pivotal axes, and (h) mounting means non-rotatably connected to the reel and extending axially outside thereof, said expanding members being pivoted to the mounting means on the pivotal axes at a point disposed outside and axially spaced from the reel.

2. The improvement set forth in claim 1, wherein said actuating mechanism comprises a fluid-operable cylinder disposed outside said reel.

3. The improvement set forth in claim 2, wherein said actuating mechanism comprises an adjusting rod, operatively connected to said expanding members and connected to said cylinder outside said reel.

4. The improvement set forth in claim 1, wherein said actuating mechanism comprises an actuating rod, extending in and displaceable along said reel and actuating levers pivoted to said actuating rod and said expanding members at a point which is spaced from the pivotal axes of said expanding members.

5. The improvement set forth in claim 4, wherein said actuating rod is mounted for rotation about its axis relative to said reel.

6. The improvement set forth in claim 5, wherein said actuating levers are pivoted to said expanding members by ball joints.

7. The improvement set forth in claim 4, wherein said actuating levers are pivoted to said expanding members by ball joints.

8. The improvement set forth in claim 4, wherein said actuating levers are pivoted to said actuating rod at points disposed outside and axially spaced from said reel.

9. The improvement set forth in claim 4, wherein the coiler comprises a frame and two trunnions, non-rotatably connected to opposite ends of said reel and rotatably mounted in said frame, and said actuating levers are pivoted to said actuating rods inside said trunnions and are pivoted to said expanding members adjacent to said trunnions at points which are disposed outside and axially spaced from said reel.

10. The improvement set forth in claim 4, wherein the coiler comprises a frame and two trunnions, non-rotatably connected to opposite ends of said reel and rotatably mounted in said frame, and a bearing is non-rotatably connected to each of said trunnions and centered on said axis of said coiler shaft and said actuating rod is rotatably mounted in said bearings.

11. The improvement set forth in claim 1, wherein the coiler comprises a frame and two trunnions non-rotatably connected to opposite ends of the reel and rotatably mounted in the frame, and the expanding members are pivoted to both said trunnions on said pivotal axes.

* * * * *